United States Patent [19]

Johnston et al.

[11] 3,962,103

[45] June 8, 1976

[54] DRY POWDER LUBRICANT

[75] Inventors: William G. Johnston, Pittsburgh; Wendell C. Milz, New Kensington, both of Pa.

[73] Assignee: Aluminum Company of America, Pittsburgh, Pa.

[22] Filed: May 16, 1975

[21] Appl. No.: 578,340

[52] U.S. Cl. ..... 252/22; 72/42; 252/17; 252/18; 252/25; 252/36

[51] Int. Cl.[2] ..... C10M 3/18; C10M 5/14; C10M 7/20; C10M 7/24

[58] Field of Search ..... 72/42; 252/17, 18, 22, 252/25, 36

[56] References Cited

UNITED STATES PATENTS

| | | | |
|---|---|---|---|
| 2,760,931 | 8/1956 | Spring et al. | 252/17 |
| 3,392,117 | 7/1968 | Glasson | 252/17 |
| 3,519,571 | 7/1970 | Szczepanek et al. | 252/36 |
| 3,804,761 | 4/1974 | Milz et al. | 252/25 |

*Primary Examiner*—Delbert E. Gantz
*Assistant Examiner*—I. Vaughn
*Attorney, Agent, or Firm*—John P. Taylor

[57] ABSTRACT

A dry powder lubricant is provided comprising 1-10 carbon fatty acid salt of a group IV-A metal and an alkali metal soap wherein exposure to temperatures in excess of 100°C will cause the soap and the salt to react to form a group IV-A metal soap lubricant in situ.

6 Claims, 1 Drawing Figure

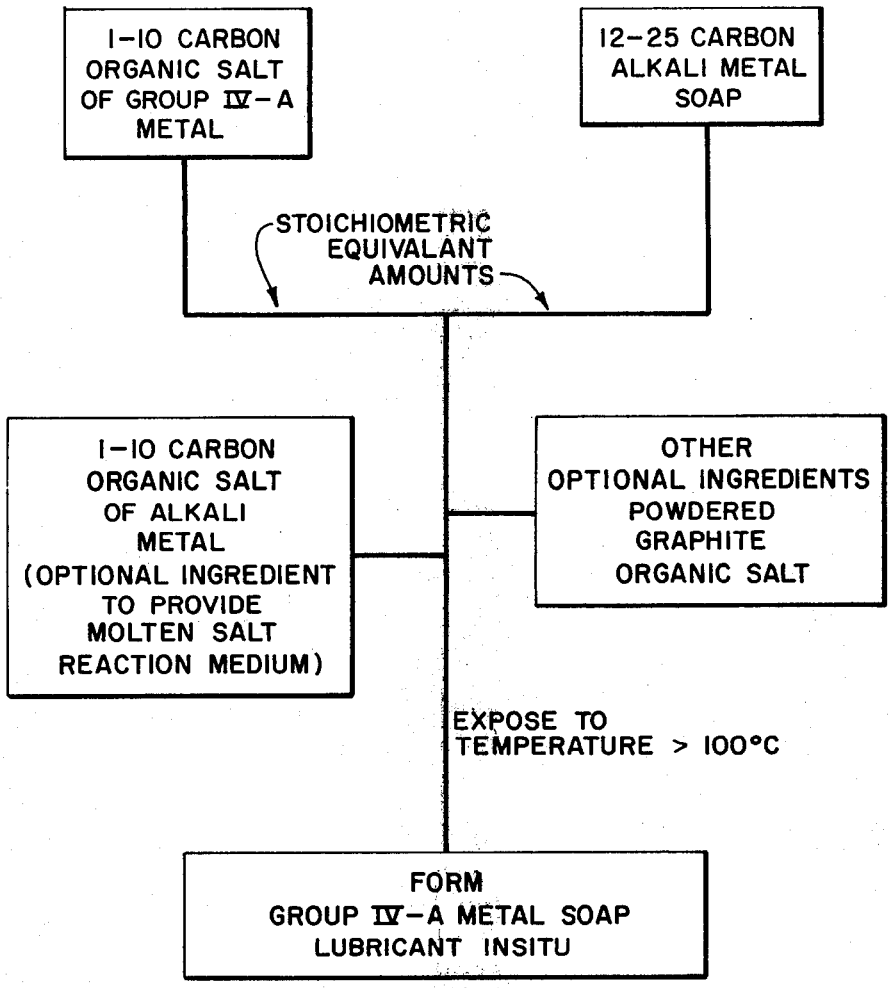
1-10 CARBON ORGANIC SALT OF GROUP IV-A METAL
12-25 CARBON ALKALI METAL SOAP
STOICHIOMETRIC EQUIVALANT AMOUNTS
1-10 CARBON ORGANIC SALT OF ALKALI METAL (OPTIONAL INGREDIENT TO PROVIDE MOLTEN SALT REACTION MEDIUM)
OTHER OPTIONAL INGREDIENTS POWDERED GRAPHITE ORGANIC SALT
EXPOSE TO TEMPERATURE > 100°C
FORM GROUP IV-A METAL SOAP LUBRICANT INSITU

DRY POWDER LUBRICANT

BACKGROUND OF THE INVENTION

This invention relates to metal-working lubricants and more particularly to a metal-working lubricant which is applied initially as a dry powder.

Conventional lubricants usually include a heavy metal soap such as lead oleate or the like. Conveniently, these materials are dispersed in an oil base. When such lubricants are used in high temperature applications such as, for example, in a forging press wherein the lubricant will be exposed to temperatures as high as about 300° to 500°C, a considerable amount of smoke and even possibly flashing can occur as the oil base is volatized off. Such emissions of smoke and fire are undesirable both from a safety and ecological viewpoint.

It would therefore be highly desirable to provide a lubricant which could be applied without the necessity of using oil bases which would be subject to such smoking and possible fire. Quite surprisingly, it has now been discovered that a dry lubricant composition can be applied which will, upon exposure to temperatures above about 100°C, form a suitable lubricant in situ.

SUMMARY OF THE INVENTION

In accordance with the invention a dry powder lubricant composition suitable for use as a high temperature forging lubricant is provided comprising a 1–10 carbon fatty acid salt of a group IV-A metal and an alkali metal soap wherein exposure to temperatures in excess of about 100°C will cause the soap and the salt to react to form a group IV-A metal soap lubricant in situ.

BRIEF DESCRIPTION OF THE DRAWING

The sole drawing of the application is a flowsheet illustrating the invention.

DESCRIPTION OF THE INVENTION

As stated above, the invention comprises a dry powder composition suitable for use as a high temperature forging lubricant and includes a 1–10 carbon fatty acid salt of a group IV-A metal and an alkali metal soap. The term "alkali metal soap" as used herein is intended to define the reaction product of an alkali metal base with a 12 to 25 carbon fatty acid.

Examples of fatty acid salts of group IV-A metals include lead acetate, tin acetate, lead butyrate, tin butyrate, lead octoate, or tin octoate.

Examples of alkali metal soaps include sodium oleate, sodium stearate, sodium palmitate, sodium myristate, sodium laurate, potassium oleate, potassium stearate, potassium palmitate, potassium myristate, potassium laurate, sodium erucate, and sodium cerotate.

In accordance with the invention, the fatty acid salt of the group IV-A metal and the alkali metal soap are used in stoichiometric amounts to permit complete reaction to form the group IV-A metal soap. However, other ingredients may, in accordance with the invention, also be used if desired.

For example, in the preferred embodiment of the invention, a 1–10 carbon fatty acid salt of an alkali metal compound is also used to act as a molten salt medium for the reaction of the group IV-A metal fatty acid salt and the alkali metal soap. This salt medium can, for example, comprise reaction products of any of the alkali metal with a 1–10 carbon fatty acid. Such materials would include sodium acetate, potassium acetate, sodium butyrate, potassium butyrate, sodium octoate, or potassium octoate. In accordance with the invention the molten salt medium can comprise from about 30 to 60 percent of the entire weight of the dry powder composition.

Minor amounts of powdered graphite, for example, from about 10 to 15 percent by total weight of the dry powder composition may also be used as a lubricating supplement to the group IV-A metal soap lubricant formed in situ.

From 5 to 10 percent by total weight of the dry powder composition of an inorganic salt such as sodium chloride, potassium chloride, or the like, may also be used to prevent sticking of the forged pieces in the die.

To illustrate the invention, a dry powder lubricant composition was formulated comprising 48% by weight sodium acetate, 13% by weight lead acetate, 21% by weight sodium oleate, 12% by weight powdered graphite, and 6% by weight sodium chloride. This dry powder lubricant was sprayed on the hot cavity dies of a forging press used to produce motor vehicle wheels. The temperature of the dies was about 370°C. The results, from a lubrication standpoint, were found to be equal to those obtained using conventional oil base lubricants. However, the emission of smoke was considerably reduced. Furthermore, no flame-up was noted. Similar results can be obtained using other 1–10 carbon fatty acid salts of the group IV-A metal as well as using other alkali metal soaps in place of the respective lead acetate salt and the sodium oleate soap.

What is claimed is:

1. A dry powder composition suitable for use as a high temperature forging lubricant comprising a 1–10 carbon fatty acid salt of a group IV-A metal and an alkali metal soap wherein exposure to temperatures in excess of about 100°C will cause the soap and the salt to react to form a group IV-A metal soap lubricant in situ.

2. A dry powder lubricant of claim 1 wherein said fatty acid salt of the group IV-A metal and said alkali metal soap are used in stoichiometrically equal amounts to form said group IV-A metal soap lubricant in situ.

3. The lubricant of claim 2 wherein an alkali metal salt of a 1–10 carbon fatty acid is used in an amount of 40 to 60 percent by total weight of the dry powder composition to provide a molten salt medium for the reaction of said fatty acid salt of the group IV-A metal with the alkali metal soap.

4. The lubricant of claim 3 wherein powdered graphite is also used in the amount of 10 to 15 percent by total weight of the dry powder composition.

5. The lubricant of claim 3 wherein an inorganic alkali metal halide salt is used in the amount of 5 to 10 percent by total weight of the lubricant to inhibit sticking of the forged pieces in the die.

6. A dry powder lubricant composition suitable for use as a high temperature forging lubricant comprising:

a. a 1–10 carbon fatty acid salt of a group IV-A metal;

b. an alkali metal soap in an amount stoichiometrically equivalent to the amount of fatty acid salt of the group IV-A metal; and c. about 40 to 60 percent by total weight of the dry powder composition of an alkali metal salt of a 1–10 fatty acid to provide a molten salt medium wherein said fatty acid salt of the group IV-A metal and the alkali metal soap may react upon exposure to temperatures of 100°C or higher to form a group IV-A metal soap lubricant in situ.

* * * * *